US006290608B2

(12) United States Patent
Gates

(10) Patent No.: US 6,290,608 B2
(45) **Date of Patent: *Sep. 18, 2001**

(54) GOLF CLUB

(76) Inventor: Elliot C. Gates, 5485 Bounty St. SE., Prior Lake, MN (US) 55372

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,357

(22) Filed: Jan. 20, 1998

(51) Int. Cl.[7] ..... A63B 53/04; A63B 53/00

(52) U.S. Cl. ..... 473/292; 473/314; 473/350; 473/349; 473/334

(58) Field of Search ..... 473/324, 290, 473/291, 292, 293, 325–350, 305–315; D21/747, 748, 749, 750, 751

(56) References Cited

U.S. PATENT DOCUMENTS

| | | | |
|---|---|---|---|
| D. 300,547 | | 4/1989 | Kobayaski . |
| D. 337,143 | | 7/1993 | Lo . |
| D. 364,435 | | 11/1995 | Wood . |
| D. 368,753 | | 4/1996 | Blough et al. . |
| D. 370,514 | | 6/1996 | Blough et al. . |
| D. 400,625 | | 11/1998 | Kubica et al. . |
| D. 400,627 | | 11/1998 | Kubica et al. . |
| D. 405,489 | | 2/1999 | Kubica et al. . |
| D. 410,514 | | 6/1999 | Takahashi et al. . |
| 1,917,774 | * | 7/1933 | Ogg . |
| 2,361,415 | | 10/1944 | Reach . |
| 3,059,926 | * | 10/1962 | Johnstone . |
| 3,655,188 | | 4/1972 | Solheim . |
| 3,814,437 | * | 6/1974 | Winquist . |
| 3,995,865 | * | 12/1976 | Cochran . |
| 4,322,083 | | 3/1982 | Imai . |
| 4,826,172 | * | 5/1989 | Antonious . |
| 4,938,470 | * | 7/1990 | Antonious . |
| 5,039,098 | * | 8/1991 | Pelz . |
| 5,046,733 | * | 9/1991 | Antonious . |
| 5,048,835 | * | 9/1991 | Gorman . |
| 5,290,032 | * | 3/1994 | Fenton . |
| 5,328,184 | * | 7/1994 | Antonious . |
| 5,435,559 | * | 7/1995 | Swisshelm . |
| 5,451,056 | * | 9/1995 | Manning . |
| 5,549,297 | * | 8/1996 | Mahaffey . |
| 5,629,475 | * | 5/1997 | Chastonay . |

* cited by examiner

*Primary Examiner*—Sebastiano Passaniti
(74) *Attorney, Agent, or Firm*—Clayton R. Johnson

(57) ABSTRACT

The golf club in a position of use of initially impacting a golf ball at ground level has a shaft that is joined to the hosel in a horizontal plane that is parallel to ground level and at an elevation that is the same as maximum vertical spacing of the toe from the ground level and thus the plane is at an obtuse angle to the shaft central axis. The club head includes a toe bar mounted to the club head main body rear portion and is of a greater height than its transverse width and thickness and has a center line that intersects the intersection of the shaft central axis and the shaft proximal end. The weight of the toe bar is about 15 percent to 25 percent of the total head weight and located more closely adjacent to the head toe than the head heel. Further the toe bar center line is about 2.75" to 3.25" from the shaft center line as measured horizontally along the head sole. The head has a balance point on a horizontal synchronized line at an elevation of normal impact with a ball.

26 Claims, 3 Drawing Sheets

10
23
A
12
C
35
10
11
10

12
20
27
27A
28
33
32
H
23
45
12
17
13
38
20
C
37

28
29
23
27
20
13

C
10
7
12
21
18
5
14
15
22
7
F
4
r
13
4
17
29
C
17
5
6
6

C
10
23
39
32
27
H
12
40
45
30
50

17
29
17
C
39
X

FIG. 4
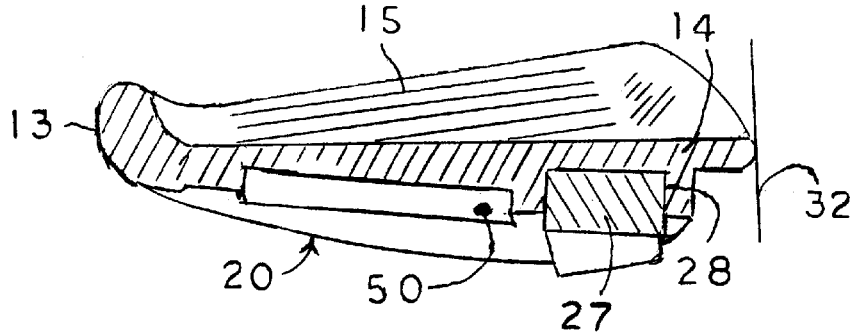
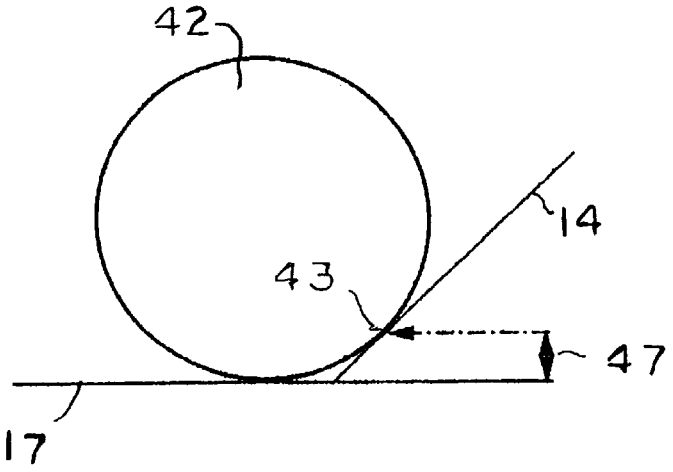
FIG 8
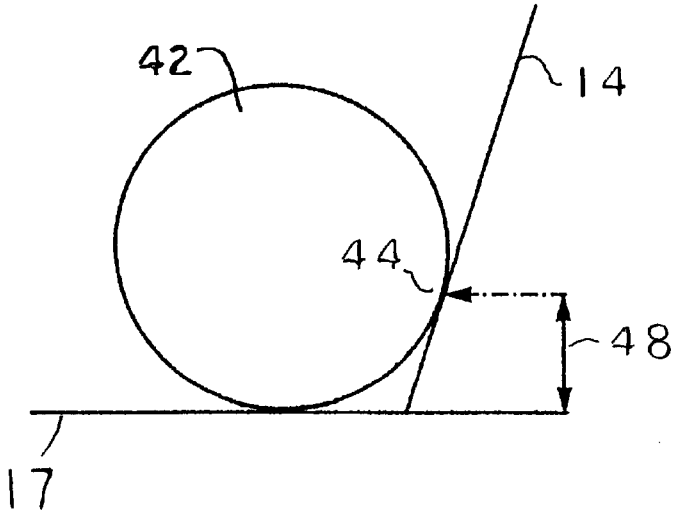
FIG 9

GOLF CLUB

BACKGROUND OF THE INVENTION

This invention relates to providing a golf club having a more balanced feel in the hands of the user and maintaining a more balance throughout the swing of the golf club.

The hands are the only sensory bond between the body, the club and the club contact with the ball while the sweet spot of the club face is the point of perfect dynamic impact in striking the ball. The sensory information in striking the ball travels through the club to the golfer.

A majority of golfers lack the skill and ability to consistently reproduce a swing that strikes the ball at the sweet spot. Further, each club has a different loft and accordingly, the initial impact with the ball will vary in elevation in accordance with the angle of the face of the respective club and therefore the location of the sweet spot. The vast majority of errant strikes are pinside or outside of the sweet spot center.

In order to minimize problems such as referred to above, this invention has been made

SUMMARY OF THE INVENTION

The golf club includes a shaft that at its juncture to the hosel is of a smaller diameter than the adjacent end of the hosel in a plane that is generally parallel to the ground when the club is being held in a position of use just as the head initially contacts the golf ball while a weight (toe bar) is mounted to the club head to give a better feel in use. The weight is located more closely adjacent to the toe end surface to have its center of mass located at an elevation just above the initial contact of the club head with the ball and on a line that passes through the top apex of a triangle having the one (top) apex at the point the shaft central axis intersects the shaft proximal end, a second apex at the intersection of the shaft central axis with the ground and a third apex at the intersection of a line perpendicular to the ground and tangential to the toe terminal edge surface horizontally most remote from the shaft axis. The weight bar is located on the side of the club face opposite the club face.

One of the objects of this invention is to provide new and novel means for maintaining the balance feel of a golf club throughout the swinging of the golf club to hit a golf ball. Another object of the invention is to provide new and novel golf club construction with a golf head having as wide a sweet spot as possible without disrupting, at any point during the swing, the balance and feel. Still another object this invention is to provide new and novel positioning of weight means on a golf club head for obtaining a wider sweet spot on the club head. An additional object of the invention is to provide a new and novel attachment of a golf club shaft to the club hosel.

In order to obtain the desired feel of a golf club, an important factor is the weight distribution when taking into consideration all elements involved in a golf swing which include the users hands, the shaft, hosel, the club head including the heel and sole and the golf ball. The desired relative placement of these elements and weight distribution of the elements of the club depend on the elevation of the sweet spot and size of the club face.

BRIEF DESCRIPTION OF THE DRAWINGS

FIG. 4 is a horizontal cross sectional view of the club head that is generally taken along the line and in the direction of the arrows 4—4 of FIG. 2 with the balance point being diametrically shown;

FIG. 8 is a schematic showing of a golf ball on the ground to indicate the elevation of a club head of a first loft of about 18 degrees striking the ball while the sole of the head is at ground level; and FIG. 9 is a showing similar to FIG. 8 other than for a loft of about 56 degrees.

DETAILED DESCRIPTION OF THE INVENTION

For purposes of the describing and claiming the invention, unless otherwise indicated, it will be described as being in its position of use just as the club face impacts the golf ball, the shaft extending upwardly from the ground, the club sole is at ground level and the shaft central axis is in a vertical plane.

Figures 1, 5, 6, 7:
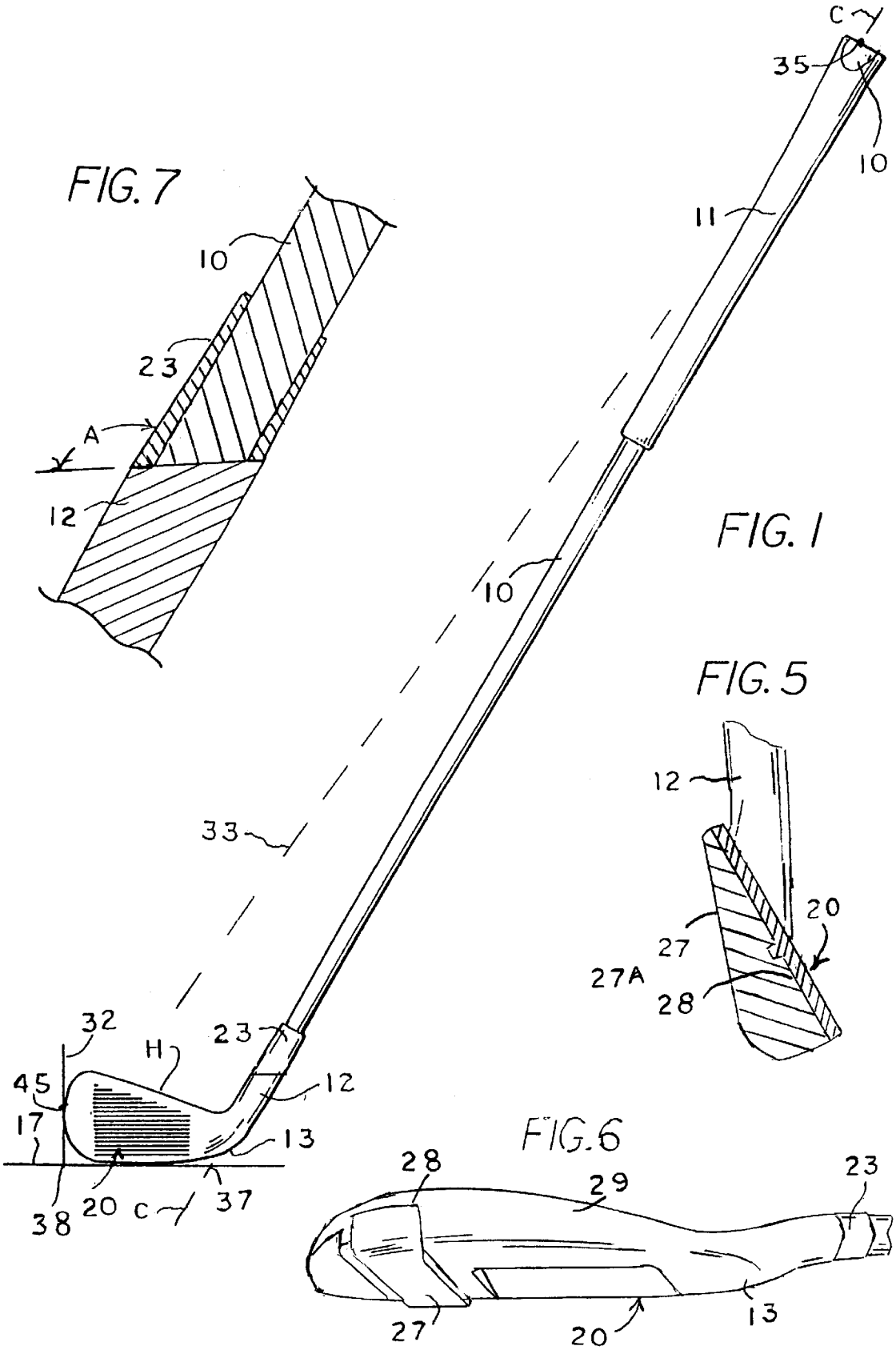
FIG. 1 is a front view of the golf club of this invention in a position of use just as it initially impacts a golf ball with a proximal end portion of the hand grip being broken away.
FIG. 5 is a vertical cross sectional view of the club head that is generally taken along the line and in the direction of the arrows 5—5 of FIG. 2.
FIG. 6 is a bottom view of the golf club that is generally taken along the line and in the direction of the arrows 6—6 of FIG. 2.
FIG. 7 is a fragmentary longitudinal cross sectional view showing the attachment of the club shaft to the hosel.
Figure 2:
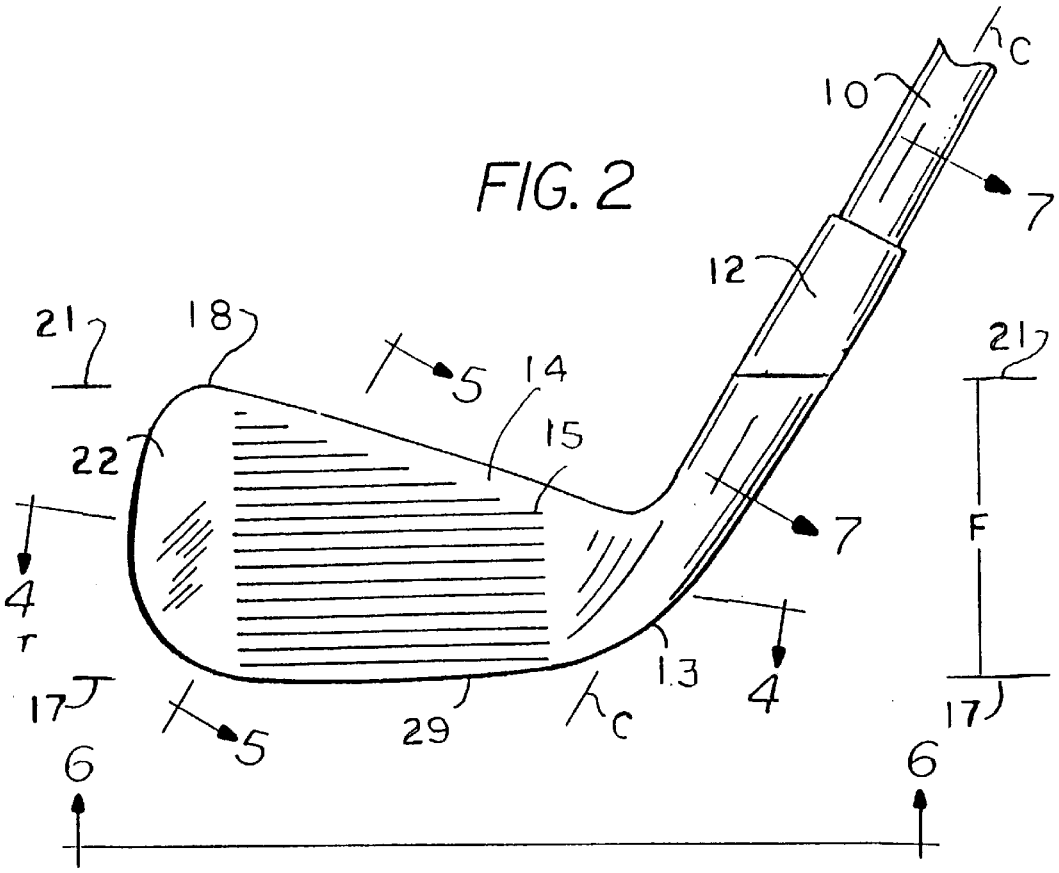
FIG. 2 is an enlarged fragmentary front view of the club head and its attachment to the club shaft.

Referring to the drawings, the golf club includes an axially (longitudinally) elongated shaft 10 having a central axis C—C and a hand grip 11 mounted to the proximal end portion thereof. The opposite end (distal end) of the shaft is joined one (top) end of the hosel 12 of the transversely elongated club head H. The head H also includes a head main body, generally designated 20, joined to the opposite end of the hosel adjacent to the heel 13 of the main body. The main body has a front (ball striking) face 14 that advantageously has a plurality of scored groves 15 that are generally parallel to the ground 17 when in a position of use of the club just prior to impacting a golf ball such as shown in FIG. 1. The face 14 may be planar other than for the grooves 15.

At the juncture of the shaft to the hosel, the hosel is of a larger diameter than that of the shaft while a somewhat frustoconical shaped ferrule 23 extends around the shaft with its major base joined to the hosel. Further, the juncture of the shaft and hosel are in a horizontal plane indicated by lines 21, the plane being generally parallel to the score grooves 15 in the main body front surface portion and the ground and at an elevation that is substantially the same as the uppermost part of the head toe 22 of the head body (terminal top surface portion 18 vertically most remote from the sole). Thus, in order to provide a greater area of bonding, the shaft is joined to the hosel along plane 21 that is at an obtuse angle A relative to the shaft central axis rather than one perpendicular to the shaft central axis. The obtuse angle is substantially greater than 90 degrees and substantially less than 180 degrees. This appears to stabilize the club head at impact.

In order to provide better balance in swinging the club, the club head includes an elongated weight (toe) bar 27 that is mounted in a cutout 28 in the back portion of the head body to be more closely adjacent to the head toe than to the head heel. Preferably, the cutout opens rearwardly with the front of the bar 27 being rearwardly of the head face 14. Desirably, the bar is of a greater height than its maximum width (dimension in the direction of the transverse elongation of the head) and thickness, but may have a bottom surface that conforms to the curvature of the main body sole 29 and to the curvature of the adjacent part of the toe. Further, it is preferred that the entire toe bar is located horizontally more closely adjacent to the toe than the heel. Advantageously, the toe bar has a post 27A extended in a correspondingly shaped aperture to aid in securing the bar to the head body.

The weight of the bar is about 15 to 25 percent of the total weight of the head, the weight of the toe bar in part depending upon the dimensions of the club. Further, the width of the bar will vary from about ½ inch to about 1 inch, depending on the materials of construction of the head body and the bar. The width of the bar used is in part dependent upon density of the materials and the positioning of the sweet spot (balance point) 50 across the face of the club. The center line 39 of the bar elongation passes through center of mass 40 of the bar and the top apex 35 which is at the intersection of the shaft central axis with the proximal end of the shaft.

A hypotenuse 33, the length of which is partially indicated by dashed line 33 and thus not fully shown, is that of a triangle (which will be referred to as a harmonic triangle) having the top apex 35 at the point the shaft central axis intersects the top end of the proximal end of the shaft, a second apex 37 at the intersection of the shaft central axis C—C with the ground (plane) 17 and a third apex 38 at the intersection of a line 32 perpendicular to the ground and tangential to the toe edge surface transversely horizontal most remote from the shaft axis.

For purposes of further describing this invention, a "synchronize elevation" is one at which the face 14 of the club main body initially hits the golf ball 42 on the ground with the sole of the club head being at ground level such as shown in FIG. 1. The synchronize elevations 47 and 48 vary with the loft of the club face as respectively shown in FIGS. 8 and 9 wherein the golf balls shown are of the same diameter and the spots of initial contact with the ball (spot 43 in FIG. 8 and 44 in FIG. 9) are shown. The above spots are in the general plane of the face of the club head and tangential to the ball when the club is being held by the user.

Figure 3:
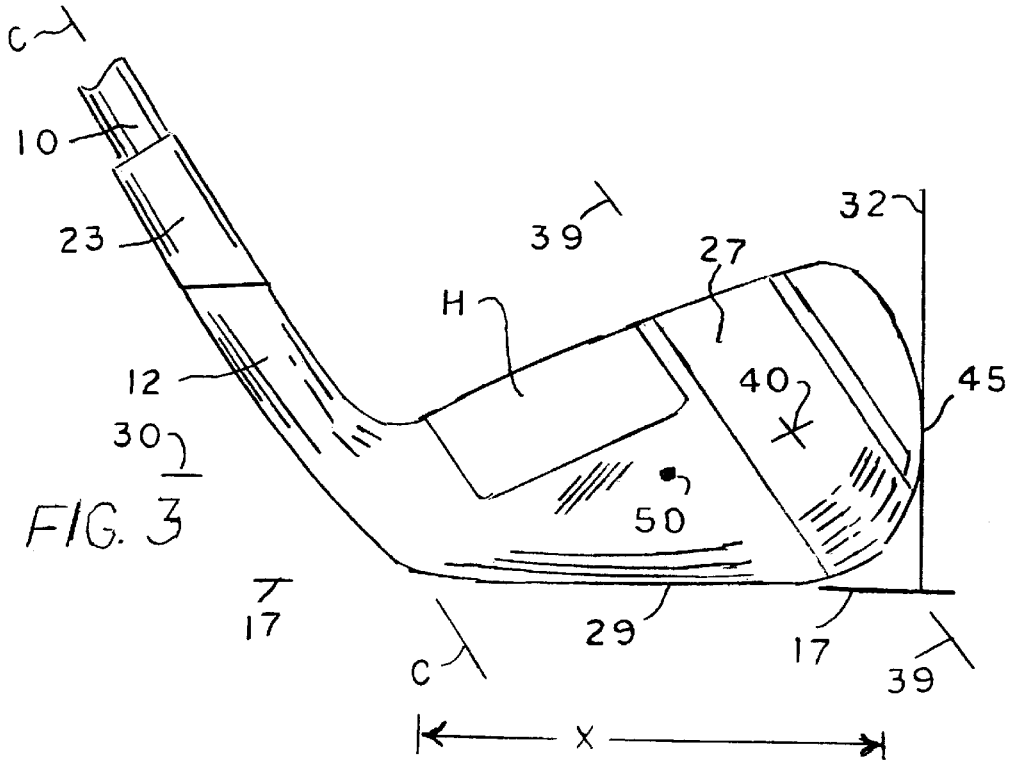
FIG. 3 is a rear view of the structure shown in FIG. 2.

With the toe bar properly located relative to the head body, the club will be balanced at two points, one being a balance point (sweet spot) 50 on a line at the synchronized elevation and the other at the proximal end of the club generally radially aligned with the apex 35 relative to the axis C—C. That is, when the shaft central axis is horizontal and the club head is generally horizontal, the weight distribution of the club will be such that, on each side of a vertical plane passing through the apex 35 and the balance point 50, the weight will be the same. The balance point (point 50 on line 30) at the synchronized elevation is located at least one half the distance from the central axis of the shaft to the part (point 45 on the vertically extending terminal edge) of the toe that is the furthest transversely horizontally remote from the shaft central axis in the direction of elongation of the club head or more than one half the above distance toward said toe part. Preferably the entire toe bar is located transversely more remote from the shaft central axis than the balance point. Additionally, it is preferred that the center line 39 of the bar 27 is located about 2.75" to 3.25" from the shaft central axis as measured horizontally across the sole of the club head (along ground level 17 as shown in FIG. 3 and indicated as dimension X). The angle of the center line 39 of the bar relative to the ground level (ATB angle) ranges from about 50 degrees to 59 degrees, depending on the club.

Preferably, the toe bar angle varies with the standard weight of the club head and the standard length of the shaft as measured from the shaft proximal end to the heel along the shaft center line. The provision of the toe bar results in the balance point 50 being located transversely horizontally more remote from the shaft central axis than without the toe bar and the cutout 28. As examples, preferably for a No. 1 iron, the standard hosel angle (angle of elongation of the hosel relative to ground level and opening toward the user) would be 56 degrees, the toe bar angle would be 51 degrees, a standard head weight of 230 grams, and a standard shaft length of 39.5" while for a No. 9 iron, the standard hosel angle would be 64 degrees, the toe bar angle would be 59 degrees, a standard head weight of 286 grams and a standard shaft length of 35.5". By providing a golf club with a toe bar such as described above, there is obtained a better balance between the hands and the sweet spot and thereby better performance is obtained. Further, there is provided a transversely wider sweet spot as a result of having the toe bar.

The horizontal plane of the top of the hosel varies due to the shape of the club head and the club face height and accordingly the top of the toe. The top of the hosel is a factor in providing the desired weight distribution and sweet spot size (balance point). Even though it is preferred that the plane of juncture of the hosel to the shaft is through portion 18, the height of the juncture F may be1.25" to 3.5" above the bottom of the sole 29.

The weight of the toe bar and the angle of the toe bar center line vary with heads of different sizes, shapes and sizes while the synchronized elevation varies with the loft of the club face.

What is claimed is:

1. A golf club in its position of use for initially impacting a golf ball at ground level, comprising an elongated shaft having a central axis, a proximal end and a distal end, a club head having a main body, a toe bar and a hosel having one end joined to the shaft distal end and an opposite end joined to the main body to mount the club head to extend transversely away from the central axis, the main body having a face, a back side portion, an elongated sole, a heel adjacent to the hosel and a toe transversely horizontally remote from the central axis and having a vertically extending end surface transversely horizontally remote from the central axis, the club head having a horizontal synchronized elevation line adjacent to where the face normally initially impacts a golf ball and a balance point along the synchronized line, the toe bar resulting in the balance point being more remote from the central axis, the toe bar being transversely more remote from the central axis than the balance point and of a weight of about 15 percent to 25 percent of the club head weight, the toe having a top surface portion vertically most remote from the sole, the head face having horizontal grooves and the hosel being joined to the shaft along a horizontal plane that is generally parallel to the ground, is at an elevation that is substantially the same as the toe top surface portion and is at an obtuse angle relative to the shaft central axis.

2. The golf club of claim 1 wherein the hosel at its juncture to the shaft is of a larger diameter than the shaft at its juncture to the hosel and a ferrule is provided on the shaft in abutting relationship to the hosel.

3. A golf club in its position of use for initially impacting a golf ball at ground level, comprising an elongated shaft having a central axis, a proximal end and a distal end, a club head having a main body and a hosel having one end joined to the shaft distal end and an opposite end joined to the main body to mount the club head to extend transversely away from the central axis, the main body having a front face, a back side portion, a transversely elongated sole, a heel adjacent to the hosel and a toe transversely horizontally remote from the central axis, the toe having a vertically extending end surface that is the furthest transversely horizontally remote from the central axis, the toe having a terminal top surface portion vertically most remote from the sole, and the hosel being joined to the shaft along a horizontal plane that is parallel to the ground level and at an elevation that is 1.25" to 3.5" above the bottom of the sole and is at an obtuse angle relative to the shaft central axis that is substantially greater than 90 degrees and substantially less than 180 degrees, the plane of the juncture of the hosel to the shaft being at substantially the same elevation as the toe terminal top surface.

4. The golf club of claim 3 wherein the hosel at its juncture to the shaft is of a larger diameter than the shaft is at its juncture to the hosel.

5. A golf club in its position of use for initially impacting a golf ball at ground level, comprising an elongated shaft having a central axis, a proximal end and a distal end, a club head having a main body, a toe bar and a hosel having one end joined to the shaft distal end and an opposite end joined to the main body to mount the club head to extend transversely away from the central axis, the main body having a face, a back side portion, an elongated sole, a heel adjacent to the hosel and a toe transversely horizontally remote from the central axis and having a vertically extending end surface transversely horizontally remote from the central axis, the club head having a horizontal synchronized elevation line adjacent to where the face normally initially impacts a golf ball during normal usage and a balance point on the synchronized line, the toe bar being transversely more remote from the central axis than the balance point and of a weight of about 15 percent to 25 percent of the club head weight, the toe bar being of a greater height than its transverse width and thickness, the toe having a terminal end surface that is located transversely remote from the club central axis, the horizontal synchronize elevation line being at an elevation that the head impacts the golf ball during normal use, the toe bar being mounted to provide a weight distribution of the club that is the same on either transverse side of a vertical plane passing through said point and the intersection of the shaft central axis with the shaft proximal end when the shaft and the head extend generally horizontally, the balance point being located more closely adjacent to the toe end surface than the heel.

6. A golf club in its position of use for initially impacting a golf ball at ground level, comprising an elongated shaft having a central axis, a proximal end and a distal end, a club head having a main body, a toe bar of a greater height than its transverse width and thickness and a hosel having one end joined to the shaft distal end and an opposite end joined to the main body to mount the club head to extend transversely away from the central axis, the main body having a face, a back side portion, an elongated sole, a heel adjacent to the hosel and a toe transversely horizontally remote from the central axis and having a vertically extending end surface transversely horizontally remote from the central axis, the club head having a synchronized elevation line adjacent to where the face normally initially impacts a golf ball and a balance point along the synchronized line, the toe bar having a center of mass and a center line that passes through the center of mass and closely adjacent to the intersection of the shaft central axis with the shaft proximal end and being transversely more remote from the central axis than the balance point and of a weight of about 15 percent to 25 percent of the club head weight.

7. The golf club of claim 6 wherein the toe bar center line as measured horizontally along the sole is about 2.75" to 3.25" from the shaft center line.

8. The golf club of claim 6 wherein the toe bar center line extends at an angle of about 50 degrees to 59 degrees to the ground.

9. A golf club in its position of use for initially impacting a golf ball at ground level, comprising an elongated shaft having a central axis, a proximal end and a distal end, a club head having a main body, a toe bar and a hosel having one end joined to the shaft distal end and an opposite end joined to the main body to mount the club head to extend transversely away from the central axis, the main body having a front face, a back side portion, an elongated sole, a heel adjacent to the hosel and a toe transversely horizontally remote from the central axis, the toe having a vertically extending end surface that is the furthest transversely horizontally remote from the central axis, the toe bar being mounted to the main body back portion and entirely transversely more closely adjacent to the toe than to the heel, the toe bar having a center of mass and a center line passing through the center of mass and the intersection of the shaft central axis with the shaft proximal end, the toe bar center line along the horizontally along the sole being transversely spaced from the shaft center line by a distance of about 2.75" to 3.25" and the center of mass is more closely adjacent to the toe end surface than the heel.

10. The golf club of claim 9 wherein the toe bar is about 15 percent to 25 percent of the weight of the club head.

11. The golf club of claim 9 wherein the toe bar is of a greater height than its thickness and transverse width and is of a width of about ½ to 1".

12. The golf club of claim 9 wherein the toe bar center line extends relative to the ground level at an angle of about 50 degrees to 59 degrees.

13. The golf club of claim 9 wherein the hosel is joined to the shaft along a horizontal plane that is parallel to ground level and is at an elevation that is 1.25" to 3.5" above the bottom of the sole.

14. A golf club in its position of use for initially impacting a golf ball at ground level, comprising an elongated shaft having a central axis, a proximal end and a distal end, a club head having a main body, a toe bar mounted to the main body back portion more closely adjacent to the toe than the heel, the toe bar being of a greater height than its transverse width and having a center line that passes through the intersection of the shaft central axis with the shaft proximal end and extends at an angle of about 50 degrees to 59 degrees and the center line is horizontally spaced along the sole from the shaft central axis by about 2.76" to 3.25" and a hosel having one end joined to the shaft distal end and an opposite end joined to the main body to mount the club head to extend transversely away from the central axis, the main body having a front face, a back side portion, a transversely elongated sole, a heel adjacent to the hosel and a toe transversely horizontally remote from the central axis, the toe having a vertically extending end surface that is the furthest transversely horizontally remote from the central axis, the toe having a terminal top surface portion vertically most remote from the sole, and the hosel being joined to the shaft along a horizontal plane that is parallel to the ground level and at an elevation that is 1.25" to 3.5" above the bottom of the sole and is at an obtuse angle relative to the shaft central axis that is substantially greater than 90 degrees and substantially less than 180 degrees.

15. The golf club of claim 14 wherein a ferrule is mounted to the shaft adjacent the hosel, the toe has a vertically extending terminal edge and the head has a horizontal synchronized elevation line at a height that the club face initially impacts a golf ball at ground level and the shaft and club head in combination, when being in a horizontal plane, are of a weight distribution to be equally distributed on each side of a vertical plane that passes through the intersection of the central axis with the shaft proximal end and intersects the synchronized line at a point defining a balance point, the toe bar being of a weight and being horizontally spaced from the shaft central axis to have the balance point located more closely adjacent to the toe vertically extending terminal edge than to the heel.

16. A golf club in its position of use for initially impacting a golf ball at ground level, comprising an elongated shaft having a central axis, a proximal end and a distal end, a club head having a main body, a toe bar and a hosel having one end joined to the shaft distal end and an opposite end joined to the main body to mount the club head to extend transversely away from the central axis, the main body having a face, a back side portion, an elongated sole, a heel adjacent to the hosel and a toe transversely horizontally remote from the central axis and having a vertically extending end surface transversely horizontally remote from the central axis, the club head having a horizontal synchronized elevation line adjacent to where the face normally initially impacts a golf ball and a balance point along the synchronized line, the toe bar resulting in the balance point being more remote from the central axis, the toe bar being transversely more remote from the central axis than the balance point and of a weight of about 15 percent to 25 percent of the club head weight, the toe bar being of a greater height than its transverse width and thickness.

17. The golf club of claim 16 wherein the width of the toe bar is about ½" to 1".

18. A golf club comprising:

an elongated shaft having a central axis, a proximal end, and a distal end;

a club head having a main body, a toe bar, and a hosel having one end joined to the shaft distal end and an opposite end joined to the main body to mount the club head to extend transversely away from the central axis, the main body having a face, a back side portion, an elongated sole, a heel adjacent to the hosel, and a toe transversely horizontally remote from the central axis with a vertically extending end surface transversely horizontally remote from the central axis, the club head having a horizontal synchronized elevation line adjacent to where the face normally initially impacts a golf ball and a balance point along the synchronized elevation line;

wherein the toe bar is mounted to a back portion of the main body; and wherein the hosel is joined to the shaft along a horizontal plane generally parallel to the sole at an obtuse ankle relative to the shaft central axis.

19. The golf club of claim 18, wherein the toe bar is of a weight of about 15 percent to about 25 percent of the club head weight.

20. The golf club of claim 18, wherein the toe bar has a width of about a half of an inch to about one inch.

21. A golf club comprising:

an elongated shaft having a central axis, a proximal end, and a distal end;

a club head having a main body with a face, a back side portion, a transversely elongated sole and a heel;

a weight located on the back side portion of the main body for enlarging a sweet spot on the face of the main body; and a hosel having one end joined to the shaft distal end along a generally horizontal plane that is substantially parallel to the sole at an elevation of about 1.25 to 3.5 inches above the bottom of the club head forming an obtuse angle relative to the shaft central axis, and having an opposite end joined to the main body to mount the club head so that the club head extends transversely away from the central axis of the shaft.

22. A golf club comprising:

an elongated shaft having a central axis, a proximal end, and a distal end;

a club head joined to the shaft distal end, the club head having a main body and a toe bar; wherein the main body comprises a face with horizontal grooves, a back side portion, an elongated sole, a heel adjacent the central axis, and a toe transversely horizontally remote from the central axis of the shaft, having a vertically extending end surface transversely horizontally remote from the central axis, and having, a top surface portion vertically most remote from the sole;

a hosel mounting the club head to the shaft, wherein the hosel is joined to the shaft along a horizontal plane generally parallel to the sole at an obtuse angle relative to the shaft central axis;

a horizontal synchronized elevation line on the club head adjacent to where the face normally impacts a golf ball; and a balance point along the synchronized line;

wherein the toe bar is mounted on the back side portion of the main body.

23. The golf club of claim 22, wherein the toe bar alters the position of the balance point.

24. The golf club of claim 33, wherein the toe bar positions the balance point further away from the central axis.

25. A golf club comprising:

an elongated shaft having a central axis, a proximal end, and a distal end;

a club head joined to the shaft distal end, the club head having a main body and a toe bar; wherein the main body comprises:

a face with horizontal grooves, a back side portion, an elongated sole, a heel adjacent the central axis, and a toe transversely horizontally remote from the center axis of the shaft, having a vertically extending end surface transversely horizontally remote from the central axis, and having a top surface portion vertically most remote from the sole;

a hosel mounting the club head to the shaft, wherein the hosel is joined to the shaft along a generally horizontal plane generally parallel to the sole at an elevation about 1.25 inches to about 3.5 inches above the sole;

a horizontal synchronized elevation line on the club head adjacent to where the face normally impacts a golf ball; and a balance point along the synchronized line;

wherein the toe bar is mounted on the back side portion of the main body and weighs about 15 to about 25 percent of the club head.

26. A golf club comprising:

an elongated shaft having a central axis, a proximal end, and a distal end;

a club head having a main body, a toe bar, and a hosel having one end joined to the shaft distal end and an opposite end joined to the main body to mount the club head to extend transversely away from the central axis, the main body having a face, a back side portion, an elongated sole, a heel adjacent to the hosel, and a toe transversely horizontally remote from the central axis with a vertically extending end surface transversely horizontally remote from the central axis and having a vertically extending end surface transversely horizontally remote from the central axis, the club head having a horizontal synchronized elevation line adjacent to where the face normally initially impacts a golf ball and a balance point along the synchronized elevation line;

wherein the toe bar is mounted to provide a weight distribution of the club that is essentially equal on either transverse side of a vertical plane passing through the balance point and the intersection of the shaft central axis with the shaft proximal end when the shaft and the head extend generally horizontally; and wherein the hosel is joined to the shaft along a horizontal plane generally parallel to the ground at an obtuse angel relative to the shaft central axis.

* * * * *